United States Patent [19]

Chiba et al.

[11] Patent Number: 4,543,510

[45] Date of Patent: Sep. 24, 1985

[54] LIQUID COOLED CATHODE RAY TUBE WITH REDUCED INTERNAL REFLECTANCE

[75] Inventors: Tomosuke Chiba, Matsudo; Hiroshi Kato, Kawasaki; Takashi Suganuma, Hiratsuka, all of Japan

[73] Assignee: Sony Corporation, Tokyo, Japan

[21] Appl. No.: 472,750

[22] Filed: Mar. 7, 1983

[30] Foreign Application Priority Data

Mar. 10, 1982 [JP] Japan ..... 57-37456

[51] Int. Cl.[4] ..... H01J 31/00; H01J 7/24

[52] U.S. Cl. ..... 313/477 R; 313/478; 313/35; 313/44

[58] Field of Search ..... 313/35, 36, 44, 45, 313/461, 474, 477 R, 478, 479

[56] References Cited

U.S. PATENT DOCUMENTS 2,342,778 2/1944 Wolff ..... 313/477 R X
2,616,057 10/1952 Coltman ..... 313/474
3,524,197 8/1970 Soule ..... 313/44 X
3,531,674 9/1970 Spencer ..... 313/44

FOREIGN PATENT DOCUMENTS 2098393A 11/1982 United Kingdom ..... 313/478

*Primary Examiner*—David K. Moore
*Assistant Examiner*—K. Wieder
*Attorney, Agent, or Firm*—Hill, Van Santen, Steadman & Simpson

[57] ABSTRACT

A cathode ray tube apparatus including an envelope having a panel portion with a phosphor screen formed on the inner surface thereof, a neck portion provided with an electron gun therein and a funnel portion therebetween; and a transparent panel facing the external surface of the panel portion with a peripherally located spacer therebetween, wherein a liquid coolant is sealed in the space formed between the panel portion and the transparent panel by light absorbing material, and the spacer is treated to reduce reflection.

5 Claims, 3 Drawing Figures

LIQUID COOLED CATHODE RAY TUBE WITH REDUCED INTERNAL REFLECTANCE

BACKGROUND OF THE INVENTION

1. Field of the Invention

This invention relates generally to a cathode ray tube apparatus and particularly is directed to a liquid cooling type cathode ray tube apparatus suitable for video projectors.

2. Description of the Prior Art

As is well known, a color video projector of, for example, three-tube type includes three cathode ray tubes which are respectively supplied with red, green and blue signals and produce red green and blue picture images, respectively. The red picture image, the green picture image and the blue picture image generated from the respective cathode ray tubes are respectively projected through optical lens systems, which are respectively placed in front of the panels of the cathode ray tubes so as to magnify them, on a picture screen on which they are composed as a color picture image. In the cathode ray tube for video projectors as described above, it is usual that a high voltage ranging from 26 KV to 30 KV is supplied to a phosphor screen for the purpose of obtaining a high luminous or bright image as compared with that of a general television receiver. In this case, to avoid the brightness of the phosphor screen from being deteriorated by the temperature increase in a phosphor screen of the cathode ray tube by the high voltage operation, a liquid cooling type cathode ray tube is employed.

The fundamental structure of the aforenoted liquid cooling type cathode ray tube is disclosed in the U.S. patent application Ser. No. 156,204 of the same assignee and now abandoned. Its practical example is shown in FIGS. 1 and 2.

As shown in FIGS. 1 and 2 in front of a first glass panel on which a phosphor screen 6 is formed, on a phosphor panel portion 2 of a cathode ray tube envelope, there is located a second glass panel, or front panel portion 1 with a spacer 3 therebetween. A liquid coolant 4 is sealed in the space formed between the panel portions 1 and 2. As the liquid coolant 4, a mixture of, for example, ethylene glycol and water may be used. The spacer 3 is formed as a frame-shape by a die casting process of, for example, aluminium and is sealed between the panel portions 1 and 2 by a resinuous bonding layer 5 in liquid-tight relationship. The spacer 3 serves as a heat radiation plate contacted with the liquid coolant 4 to radiate the heat generated in the liquid coolant 4, and also as an attaching plate securing for the cathode ray tube to a predetermined cabinet therein. In the figures, numeral 7 denotes a funnel portion connected to a neck portion 10 in which an electron gun 11 is provided, and 8 denotes a frit glass by which the funnel portion 7 and the phosphor panel portion 2 are sealed in air-tight relationship. In this liquid cooling type cathode ray tube, even if the temperature of the phosphor screen 6 becomes high by the scanning of a high voltage electron beam, the heat is transmitted or conducted through the phosphor panel portion 2 to the liquid coolant 4 and then radiated through the spacer 3 or radiated through the front panel portion 1 so that the increase of the temperature at the phosphor screen 6 is suppressed and deterioration of the brightness of the phosphor screen is avoided.

In the conventional liquid cooling type cathode ray tube as a sealing member for both the panel portions 1 and 2, particularly the resinuous bonding layer 5, a silicone bonding agent of, for example, thermosetting type is utilized. Such silicone bonding agent is generally white. Therefore, as shown in FIG. 2, the scattered light emitted from the phosphor screen 6 is reflected on the surface of the resinuous bonding layer 5 and surface of the spacer 3 as undesired reflected light 9.

Thus, when the conventional liquid cooling type cathode ray tube is used for a video projector, such undesired reflected light 9 lowers the contrast of the video picture image at its peripheral portion projected onto the picture screen of the video projector. Particularly, in a so-called rear-projector or rear-projection type projector, due to the design of the optical lens system, an ineffective picture image with other than the phosphor screen image and including sealing-member-like shadows is projected at the peripheral portion of the video picture image on the screen. Thus, in the rear-projection type projector, not only the contrast at the peripheral portion of the video picture image is lowered, but also the video picture image is hard to see due to the undesired picture image.

OBJECTS AND SUMMARY OF THE INVENTION

Accordingly, it is an object of this invention to provide a liquid cooling type cathode ray tube apparatus which can remove an undesired reflected light on a sealing member and which is suitable for use with a video projector which can improve the contrast of the video picture image.

It is another object of this invention to provide a liquid cooling type cathode ray tube apparatus capable of improving the heat absorbing effect of a sealing member and which is superior in heat radiation effect.

According to an aspect of this invention, there is provided a cathode ray tube apparatus comprising:

(a) an envelope having a panel portion with a phosphor screen formed on the inner surface thereof, a neck portion provided with an electron gun therein, and a funnel portion therebetween;

(b) a transparent panel facing an external surface of said panel portion with a spacer therebetween; and (c) a liquid coolant sealed between said panel portion and said transparent panel with light absorbing material.

The other objects, features and advantages of the present invention will become apparent from the following description taken in conjunction with the accompanying drawing through which the like references designate the same elements and parts.

DESCRIPTION OF THE PREFERRED EMBODIMENT

Figure 3:
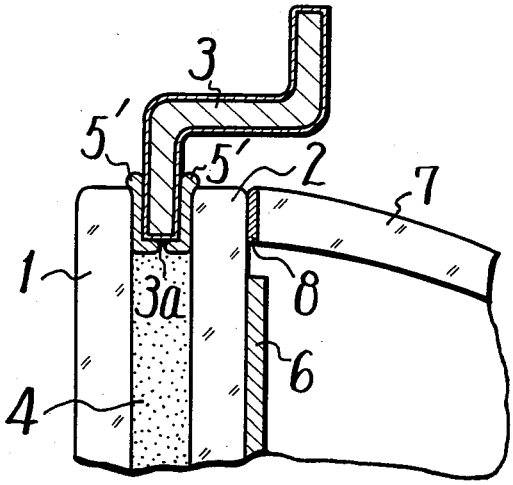
FIG. 3 is an enlarged cross-sectional view showing a main part of an example of the liquid cooling type cathode ray tube apparatus according to this invention.

Referring to FIG. 3, an embodiment of a liquid cooling type cathode ray tube apparatus according to the present invention will now be described.

In the example of the liquid cooling type cathode ray tube apparatus shown in FIG. 3, in the space formed between the phosphor panel portion 2 and the front panel portion 1 located in front thereof, the liquid coolant 4 is sealed in liquid-tight relation, as in the prior art. In the present invention, as shown in FIG. 3, both the panel portions 1 and 2 are sealed by a sealing member, namely, a resinuous bonding layer 5' and the spacer 3 which are both subjected to the following process to lower their reflection coefficient on their surfaces. As the resinuous bonding layer 5', a colored bonding agent which can easily absorb a light is utilized. As a practical color of the bonding agent, a color with a low brightness, for example, black is suitable. It is preferable but not necessary to blacken or roughen the surface 3*a* of the spacer 3. The treatment for blackening the spacer 3 on its surface 3*a* can be made by the chromium-plating or the adsorption of dye. While, after the colored resinuous bonding layer 5' is coated on both the panel portions 1 and 2 or on the spacer 3, if the panel portions 1 and 2 are pressed with the spacer 3 gripped therebetween to an unitary body, part of the resinous bonding agent 5' forms around the side surface of the spacer 3 where it contacts with the liquid coolant 4 and covers a considerably large area of the side surface of the spacer 3 in the space formed between the panel portions 1 and 2, as illustrated in FIG. 3. Thus, without blackening the surface of the spacer 3, the undesired reflected light (refer to FIG. 2) can be removed.

Figure 1:
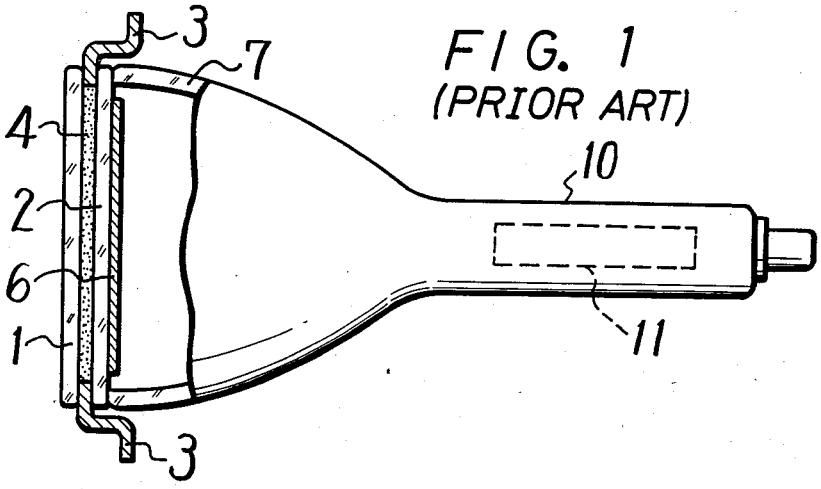
FIG. 1 (PRIOR ART)
FIG. 1 is a partially cut-out side view of a conventional liquid cooling type cathode ray tube.
Figure 2:
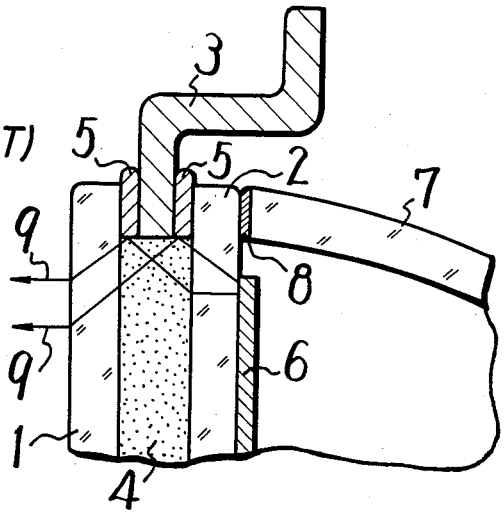
FIG. 2 (PRIOR ART)
FIG. 2 is an enlarged cross-sectional view of a main part thereof.

Though not shown in FIG. 3, the other parts and the structure of the liquid cooling type cathode ray tube apparatus according to this invention are substantially same as those of the prior art cathode ray tube apparatus shown in FIGS. 1 and 2.

In accordance with the aforenoted arrangement, since the bonding agent which absorbs the light is used as the resinuous bonding layer 5' for the sealing member between the phosphor panel portion 2 and the front panel portion 1, it is possible to prevent scattered light of the light emitted from the phosphor screen 6 from being reflected as undesired reflected light. When the cathode ray tube apparatus of this invention is used in a video projection, the contrast of the video picture image is improved at the peripheral portion of the picture screen.

Though not shown in FIG. 3, the other parts and the structure of the liquid cooling type cathode ray tube apparatus according to this invention are substantially same as those of the prior art cathode ray tube apparatus shown in FIGS. 1 and 2.

In accordance with the aforenoted arrangement, since the bonding agent which can easily absorb the light is used as the resinuous bonding layer 5' for the sealing member between the phosphor panel portion 2 and the front panel portion 1, it is possible to avoid that the scattered light of the light emitted from the phosphor screen 6 is reflected unnecessarily as the undesired reflected light. When the cathode ray tube apparatus of this invention is used in a video projector, it is possible to improve the contrast of the video picture image at its peripheral portion on the picture screen.

Moreover, if the surface 3*a* of the spacer 3 is also blackened or roughened, any undesired reflected light is further suppressed, thereby improving the contrast of the video picture image.

Furthermore, when the surface 3*a* of the spacer 3 is blackened, the heat absorbing effect thereof is improved and hence the heat radiation effect of the spacer 3 is also improved.

As described above, in this invention, the conventional white resinuous bonding layer is replaced by the resinuous bonding layer 5' which is colored, preferably in black, to absorb the light.

As set forth above, the liquid cooling type cathode ray tube apparatus according to this invention is suitable for use with video projectors and can maintain the contrast of the video picture image distinct at its peripheral portion on the picture screen.

Furthermore, the liquid cooling type cathode ray tube apparatus according to the invention improves the heat radiation effect of the sealing member between both the panel portions and prevents the brightness of the phosphor screen from deterioration by high temperature.

The above description is given on a single preferred embodiment of the invention, but is will be apparent that many modifications and variations could be effected by one skilled in the art without departing from the spirits or scope of the novel concepts of the invention, so that the scope of the invention should be determined by the appended claims only.

We claim as our invention:

1. A cathode ray tube apparatus comprising:
   (a) an envelope having a panel portion with a phosphor screen formed on the inner surface thereof, a neck portion provided with an electron gun therein, and a funnel portion therebetween;
   (b) a transparent panel facing an external surface of said panel portion with a spacer therebetween confined at the peripheral edges thereof; and
   (c) a liquid coolant between said panel portion and said transparent panel, sealed therein at the peripheral edges with a blackened light absorbing sealing material, the compression of said panel portion and said transparent panel causing the sealing material to envelop said spacer a sufficient amount to significantly reduce light reflected back into the interior of said tube.

2. A cathode ray tube apparatus according to claim 1, wherein said sealing material is blackened.

3. A cathode ray tube apparatus according to claim 1, wherein at least a portion of the surface of said spacer which is exposed to said liquid coolant is blackened.

4. A cathode ray tube apparatus according to claim 1, wherein the surface of said spacer is roughened.

5. A cathode ray tube apparatus according to claim 1, wherein the spacer and sealing material are efficient heat conductors.

* * * * *